United States Patent [19]

Hatz

[11] Patent Number: 4,975,029

[45] Date of Patent: Dec. 4, 1990

[54] FUEL INJECTION PUMP FOR AN INTERNAL COMBUSTION ENGINE HAVING PRE-INJECTION AND MAIN INJECTION

[75] Inventor: Ernst Hatz, Ruhstorf, Fed. Rep. of Germany

[73] Assignee: Motorenfabrik Hatz GmbH & Co., KG, Ruhstorf, Fed. Rep. of Germany

[21] Appl. No.: 314,138

[22] Filed: Feb. 22, 1989

[30] Foreign Application Priority Data

Mar. 23, 1988 [DE] Fed. Rep. of Germany ..... 3809700

[51] Int. Cl.[5] ..... F04B 7/04; F02M 45/06

[52] U.S. Cl. ..... 417/494; 417/499; 123/299; 123/300

[58] Field of Search ..... 123/249, 300, 447, 503, 123/506; 417/494, 499

[56] References Cited

U.S. PATENT DOCUMENTS

| | | | |
|---|---|---|---|
| 2,420,164 | 5/1947 | Bremser | 417/490 |
| 2,871,796 | 2/1959 | Dreisin et al. | 417/499 |
| 3,438,359 | 4/1969 | Thoma . | |
| 4,617,894 | 10/1986 | Kampichler . | |

FOREIGN PATENT DOCUMENTS

| | | | |
|---|---|---|---|
| 177968 | 3/1954 | Austria . | |
| 572711 | 3/1933 | Fed. Rep. of Germany | 417/494 |
| 585014 | 9/1933 | Fed. Rep. of Germany | 417/494 |
| 916605 | 8/1954 | Fed. Rep. of Germany | 417/494 |
| 948209 | 8/1956 | Fed. Rep. of Germany . | |
| 316691 | 4/1934 | Italy . | |
| 360980 | 7/1938 | Italy . | |
| 465887 | 9/1951 | Italy . | |
| 893621 | 4/1962 | United Kingdom . | |

*Primary Examiner*—Leonard E. Smith
*Assistant Examiner*—John A. Savio, III
*Attorney, Agent, or Firm*—Flynn, Thiel, Boutell & Tanis

[57] ABSTRACT

A fuel injection pump for an internal combustion engine includes at least one pump piston movably disposed in a piston sleeve which piston sleeve is fitted in a pump housing. A first arrangement associated with the piston draws fuel through suction ports into a working chamber of the pump during a piston suction stroke. A second arrangement associated with the piston cuts off a connection to a suction side of the pump and thereafter initiates a delivery from the working chamber to an injection nozzle, which delivery is divided into two phases. The second arrangement is operable during a piston delivery stroke. A third arrangement controls the phases and includes the suction ports and an inside edge of the piston sleeve. The inside edge of the piston sleeve is provided on a planar end face of a guide bore of the sleeve and faces the working chamber.

7 Claims, 1 Drawing Sheet

INJECTION NOZZLE

FUEL INJECTION PUMP FOR AN INTERNAL COMBUSTION ENGINE HAVING PRE-INJECTION AND MAIN INJECTION

FIELD OF THE INVENTION

The present invention relates to a fuel injection pump for an internal combustion engine and, more particularly, to a fuel injection pump having at least one pump piston which is movably disposed in a piston sleeve fitted tightly in the pump housing, and which, during its stroke in the suction direction, draws fuel through suction ports into the working chamber of the pump, and, during its movement in the delivery direction, first cuts off the connection to the suction side of the injection pump and then initiates delivery from the working chamber to the injection nozzle, preferably by way of a pressure valve, which delivery is divided into pre-injection and main injection.

BACKGROUND OF THE INVENTION

In such fuel injection pumps, it is very difficult to provide and check control means such as grooves, inclined edges or bores, on or in the inside surfaces of the components, so as to insure that they have the required tolerances, both in the axial and radial directions with respect to one another, which tolerances are necessary to precisely maintain the control phases. The manufacture and quality control of the measurements of such components are therefore only possible at great expense.

The present invention seeks to eliminate this disadvantage and to provide a pump which is simple to manufacture and which has dimensions which can easily be subject to control.

SUMMARY OF THE INVENTION

According to the present invention there is provided a fuel injection pump for an internal combustion engine, having at least one pump piston movably disposed in a piston sleeve fitted tightly in the pump housing, which piston, during its stroke in the suction direction, draws fuel through suction ports into a working chamber of the pump, and during its stroke in the delivery direction, first cuts off the connection to the suction side of the injection pump and then initiates delivery from the working chamber to the injection nozzle, which delivery is divided into pre-injection and main injection, wherein only the suction ports and an inside edge of the piston sleeve, which edge is provided on a planar end face of a guide bore of the sleeve, facing the working chamber, are used to control the injection phases, and all the other control arrangements of the injection pump are associated with the pump piston.

In a preferred embodiment of the present invention, the periphery of the piston, which can be rotated through a particular angle of rotation about its longitudinal axis so as to provide fuel quantity control, is provided with a recess which is defined by an inclined control edge and connected, by way of a connection line associated with the piston, to the working chamber, and which recess cooperates by way of its oblique control edge with one of the suction bores. Two control recesses are provided diametrically opposite one another on the periphery of the piston, extend over an angle which substantially corresponds to the aforesaid angle of rotation, and have dimensions, in the axial direction of the piston, defined by radial edges. Each control recess cooperates with one of two suction ports in the piston sleeve, which are also disposed diametrically opposite one another. This embodiment, having mutually diametrically opposite control arrangements between the piston and the piston sleeve, has the further advantage that approximately the same surface pressures prevail on both longitudinal sides of the piston, in particular during the high fuel pressure phase, thus eliminating the so-called piston wear which arises as a result of excessive surface friction when the piston is subject to excess pressure on one side.

According to an advantageous feature of the present invention, the angular distance of each control recess on the piston periphery is approximately 120°, and the two control recesses are separated from one another by angular portions of the periphery of the piston which extend for an angular distance of about 60° such that the control recesses do not communicate. Given such angular values for the control recesses and their radial edges, it is ensured that the various control phases begin and end as required, and hence the desired exact separation between pre-injection and main injection is achieved. Furthermore, a return line, required to return the leakage fuel, may advantageously be provided by way of one of the angular portions of the piston.

Advantageously the control recesses and their radial edges may be arranged in a variety of configurations on the piston. One control recess may open from the end face of the piston facing into the working chamber, whereas another control recess may be provided having its two radial limiting edges below the end face of the piston. Alternatively, both control recesses may be located with their radial edges below the end face of the piston.

A further advantageous feature of the present invention may be provided in which a cylindrical intermediate member having an inner bore is seated on the end face of the piston, the diameter of the inner bore is larger than the inner diameter of the piston sleeve guide bore and the inner bore of the intermediate member serves to define the pump working chamber. The intermediate member may be inserted in the pump housing between the piston sleeve and the pressure valve housing.

BRIEF DESCRIPTION OF THE DRAWINGS

The invention is described further hereinafter, by way of example only, with reference to the accompanying drawings, in which.

DETAILED DESCRIPTION

Figures 1, 2, 3, 4, 5, 6, 7, 8:
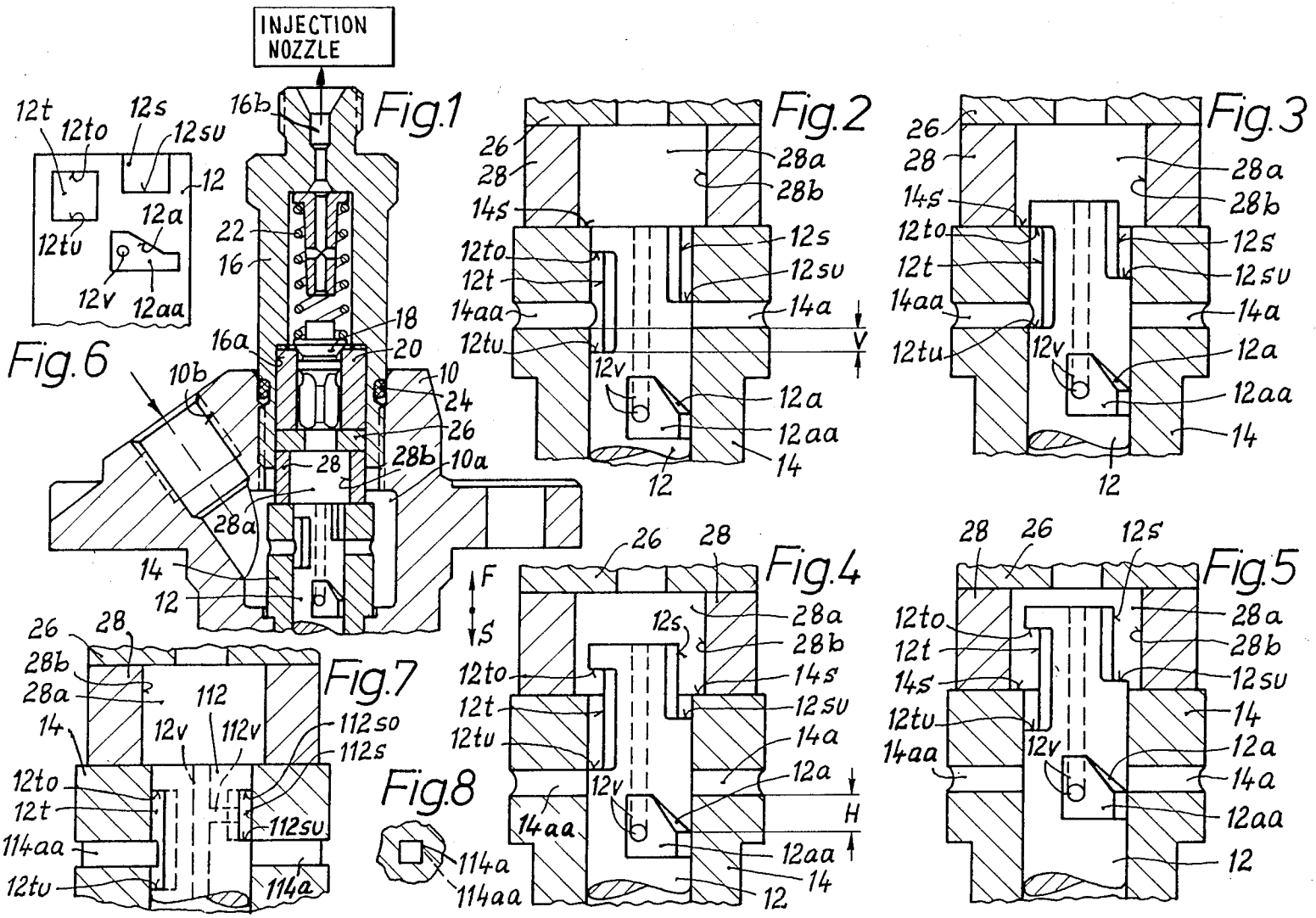
FIG. 1 is a partial longitudinal section of a single-cylinder injection pump in accordance with one embodiment of the present invention.
FIGS. 2 to 5 show details of the pump of FIG. 1 on an enlarged scale and in various operating positions.
FIG. 6 illustrates the unrolled surface of the piston of FIG. 1.
FIGS. 7 and 8 illustrate variations of the details of FIG. 1.

FIG. 1 shows an injection pump having a housing 10 and a piston 12, which is guided in a piston sleeve 14 fitted tightly in the pump housing. During the delivery stroke, the piston is driven out of its bottom dead center position in the direction F by an eccentric cam of a drive shaft and during the suction stroke in direction S, a return spring moves the piston in FIG. 1 downward, out of the top dead center position. The piston can be rotated about its longitudinal axis so as to adjust its inclined control edge 12*a*, in a recess 12*aa*, into various positions relative to a suction bore 14*a* in the piston sleeve 14 to thereby control the quantity of fuel delivered. The details of such a pump drive and quantity control are known, for example, from Great Britain Patent No. 2 458 463 and therefore are not shown here.

A suction chamber 1O*a* surrounding the piston sleeve 14 in the housing 10 is connected to a suction line, whose connecting nipple can be screwed into a threaded bore 10*b* of the housing 10. The pressure line leading to the injection nozzle can be connected to a connecting nipple 16, through which fuel may be delivered by the piston 12 by way of a pressure valve 18, which valve 18 is guided in a pressure valve housing 20 and may be opened by the pressure of the fuel acting against a return spring 22. A bore 16*b* of the nipple 16 leads to the injection nozzle. The nipple itself is screwed in the housing 10 with the interposition of a sealing ring 24.

The injection pump described in the above-mentioned patent specification is used only for main injection of fuel. In order for such a pump to provide pre-injection, the following control elements are used in addition to the above-mentioned known elements.

An annular disc 26 and an intermediate member 28 are inserted into the inner bore 16*a* of the nipple 16 which accommodates the pressure valve housing 20 in such a way that, when the nipple 16 is tightened in the housing 10, the intermediate member 28 is seated on the end face of the piston sleeve 14. The inside face 28*b* of the intermediate member 28 defines a cylindrical chamber 28*a*, which acts as the working chamber of the pump.

The unrolled illustration in FIG. 6 shows the periphery of the piston 12 with a control recess 12*s* and a control recess 12*t*. These recesses are disposed so as to be diametrically opposite one another, and each extends approximately over an angle of 120° of the piston periphery. The control recess 12*s* cooperates with the suction bore 14*a*, while the control recess 12*t* cooperates with a suction bore 14*aa*, which is diametrically opposite 14*a*. The control recess 12*s* opens into the working chamber 28*a* and is defined in an axial direction by a radial edge 12*su*. The axial dimension of the control recess 12*t* is defined by two radial edges 12*to* and 12*tu*. A connecting bore 12*v* connects the working chamber 28*a* to the recess 12*aa*. The chamber 28*a* and recess 12*aa* may alternatively communicate by way of an axial groove on the piston periphery.

In the illustrated arrangement, fuel is delivered in the following way.

Fuel is drawn out of the suction chamber 10*a* by way of the suction bore 14*a* and control recess 12*s* into the working chamber 28*a*, as the piston 12 moves during the suction stroke S from its top dead center to its bottom dead center and its control recess 12*s* slides past the suction port 14*a* (shown as position A in dashed lines in FIG. 2) so as to open it. As soon as the piston 12 moves during the delivery stroke F from the bottom dead center to the top dead center and the radial edge 12*su* of the control recess 12*s* closes off the suction port 14*a* (FIG. 2), fuel delivery commences from the working chamber 28*a* to the injection nozzle, by way of the short stroke path V, since fuel is prevented from returning through the other suction port 14*aa* because it is covered by the control recess 12*t*. This small quantity is used for pre-injection. Pre-injection is terminated as soon as the upper radial edge 12*to* of the control recess 12*t* slides past the annular edge 14*s* on the end face of the piston sleeve 14 during the course of the continued piston stroke in the direction F. The return flow path from the working chamber 28*a* to the suction side 1O*a*, by way of the recess 12*t* and the suction bore 14*aa* (FIG. 3) is then opened.

Following a predetermined interval after termination of pre-injection, the lower radial edge 12*tu* slides completely past the suction port 14*aa*, so that the return flow path of the fuel is cut off (FIG. 4). Main injection of fuel then commences from the working chamber 28*a* to the injection nozzle, and continues during the course of the continued piston stroke in the direction F until, following a stroke path H the control edge 12*a* of the recess 12*aa* slides past the suction port 14*a* and reopens the return path 12*v*, 12*aa*, 14*a* from the working chamber 28*a* to the suction side 10*a* (FIG. 5), thus terminating main injection.

In FIGS. 7 and 8, both the control recess 12*t* and the control recess 112*s* are disposed below the end face of the piston 112 and have longitudinal dimensions determined by their radial edges 12*to*, 12*tu*, and 112*so*, 112*su*. The connecting bore 12*v* and recess 112*s* communicate by way of a transverse bore 112*v*. This variant operates in the same way as the embodiment in FIGS. 2 to 5. FIG. 8 shows that the suction ports 114*a* and 114*aa* may also have a rectangular cross-section. This has the advantage that abrupt opening or closing of the control recesses can be obtained. It should be noted that the suction ports in FIGS. 1 to 5 may also have such a rectangular shape.

The quantity of fuel delivered during main injection in the embodiment described can be controlled as required by rotating the pump piston 12, 112 about its longitudinal axis, such that its oblique control edge 12*a* is angularly displaced relative to the suction port 14*a*, 114*a*. In contrast, the pre-injection quantity remains constant, which, in most internal combustion engines, is sufficient to obtain optimum ignition with subsequent combustion. However, it is possible to provide a variety of pistons having the control recesses in different positions, so that an appropriate piston can be selected according to the given operating conditions and inserted into the pump so as to vary the control phases and obtain the desired pre-injection quantity.

Finally, it should be mentioned that, with the aid of the radial edges of the control recesses, which edges extend for approximately 120° on the piston periphery, the beginning and end of the control phases are precisely defined, both in pre-injection and in main injection. This ensures a clear separation between pre-injection and main injection throughout the entire load and speed range of the internal combustion engine.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A fuel injection pump for internal combustion engines, said pump having a piston rotatable through a specific angle of rotation, said pump comprising:

a pump housing;

an elongated and hollow piston sleeve tightly fitted in said pump housing, said piston sleeve having means defining therein an axially extending guide bore and a pair of transversely extending, axially aligned suction bores which open into said guide bore, said suction bores being diametrically opposed across said guide bore and being perpendicularly positioned with respect to a longitudinal axis of said piston sleeve, said piston sleeve being otherwise free throughout its longitudinal length of other operative fluid passages opening into said guide bore, means defining a working chamber in said pump housing and into which said axially extending guide bore opens;

said piston being supported for reciprocal movement along a piston axis coinciding with said longitudinal axis, said piston being movable in said guide bore, said piston including suction means operable during a stroke movement thereof in a suction direction for drawing fuel through said suction bores into said working chamber, said piston including delivery means operable during a stroke movement thereof in a delivery direction for first cutting off the connection between said suction bores and said working chamber and for then delivering fuel from said working chamber to an injection nozzle; and control means for dividing said fuel delivery into pre-injection and main injection phases, said control means including an inclined control edge on said piston for controlling an amount of fuel injection, and an annular axial end surface on said piston sleeve which faces said working chamber and defines a control edge between said guide bore and said working chamber, said annular end surface defining a plane which is perpendicular to said longitudinal axis.

2. The pump as claimed in claim 1, wherein said working chamber is defined by a cylindrical intermediate member having an inner bore, which member is seated on said end surface of said piston sleeve, and wherein the diameter of said inner bore of said intermediate member is larger than the inner diameter of said piston sleeve guide bore.

3. The pump as claimed in claim 2, wherein said intermediate member is inserted in said pump housing between said piston sleeve and a pressure valve housing.

4. The pump according to claim 1, wherein said control means includes means defining an inclined recess in an outer peripheral surface of said piston, said inclined recess having an inclined axially facing wall which defines said inclined control edge, said control means including further means defining a connecting bore in said piston which connects said inclined recess to said working chamber, said inclined recess operatively opposing one of said suction bores, and wherein said control means and said suction means respectively include means defining a control recess and a suction recess in said outer peripheral surface of said piston, said control and suction recesses being located diametrically opposite one another and each extending circumferentially through an angle approximately corresponding to the angle of rotation of said piston, said control recess and said suction recess each having at least one axially facing wall which defines a radial edge on said piston, and each being oriented on said piston to oppose one of said diametrically opposed suction bores in said piston sleeve.

5. The pump according to claim 4, wherein each of said control and suction recesses extends circumferentially through approximately 120° and is circumferentially separated from the other of said control and suction recesses by angle sections of said outer peripheral surface of said piston, said angle sections extending circumferentially through approximately 60°.

6. The pump according to claim 4, wherein said delivery means includes an axial end surface on said piston, wherein said suction recess, throughout the entire circumferential extent thereof, axially adjoins said end surface of said piston and opens into said working chamber, and wherein said control recess is axially spaced from said piston end surface and has two of said axially facing walls.

7. The pump according to claim 4, wherein said delivery means includes an axial end surface on said piston, and wherein each of said control and suction recesses is axially spaced from said piston end surface and has two of said axially facing walls.

* * * * *